US007604103B2

(12) United States Patent
Hamlin

(10) Patent No.: US 7,604,103 B2
(45) Date of Patent: Oct. 20, 2009

(54) TOOLBAG WITH EXPANDIBLE POCKETS

(75) Inventor: Brian Hamlin, McKinney, TX (US)

(73) Assignee: OmniQuest, Ltd., McKinney, TX (US)

( * ) Notice: Subject to any disclaimer, the term of this patent is extended or adjusted under 35 U.S.C. 154(b) by 474 days.

(21) Appl. No.: 11/293,968

(22) Filed: Dec. 5, 2005

(65) Prior Publication Data

US 2007/0137958 A1 Jun. 21, 2007

(51) Int. Cl.
*A45C 3/00* (2006.01)
*A45C 13/26* (2006.01)

(52) U.S. Cl. ..... 190/111; 190/103; 190/903; 150/112; 150/117; 206/372; 206/373; 383/38

(58) Field of Classification Search ..... 190/109, 190/111, 112, 126, 903, 103; 206/373, 372; 383/2, 38; 150/112, 117
See application file for complete search history.

(56) References Cited

U.S. PATENT DOCUMENTS

| | | | | |
|---|---|---|---|---|
| 4,609,084 | A * | 9/1986 | Thomas | 190/110 |
| 4,773,515 | A * | 9/1988 | Kotkins, Jr. | 190/103 |
| 4,805,749 | A * | 2/1989 | Gerch | 190/111 |
| 5,423,404 | A | 6/1995 | Shaw | 190/192 |
| D360,977 | S | 8/1995 | Katz | D3/276 |
| 5,526,907 | A * | 6/1996 | Trawick et al. | 190/111 |
| 5,653,318 | A * | 8/1997 | Field | 190/18 R |
| 6,126,003 | A * | 10/2000 | Brouard | 206/372 |
| 6,363,538 | B1 | 4/2002 | Davis | 2/247 |
| 6,478,463 | B2 * | 11/2002 | Snider | 383/18 |
| 6,571,998 | B2 | 6/2003 | Godshaw et al. | 224/607 |
| 6,742,636 | B2 | 6/2004 | Godshaw | 190/111 |
| 7,331,454 | B2 * | 2/2008 | Godshaw et al. | 206/373 |
| 2004/0016666 | A1 * | 1/2004 | Redzisz | 206/372 |
| 2004/0262111 | A1 * | 12/2004 | Ghiassi | 190/103 |
| 2005/0167306 | A1 * | 8/2005 | Ho | 206/373 |
| 2006/0027475 | A1 * | 2/2006 | Gleason et al. | 206/373 |
| 2006/0070901 | A1 * | 4/2006 | Adams et al. | 206/373 |

* cited by examiner

*Primary Examiner*—Sue A Weaver
(74) *Attorney, Agent, or Firm*—Charles D. Gunter, Jr.

(57) ABSTRACT

A tool storage bag is provided for storing tools and accessories at a work site. The tool storage bag is formed with soft sides and has external expandible pockets to accept a variety of tools and accessories. In one version, the bag has an A-frame opening which presents an unobstructed opening in the open position for receiving larger tools such as a circular saw. In another version, the tool bag has a rectangular opening which is spanned by a rigid handle with end portions which are attached to selected opposing sidewalls of the bag. The rigid handle accommodates heavier loads and adds increased stability to the bag construction.

5 Claims, 4 Drawing Sheets

TOOLBAG WITH EXPANDIBLE POCKETS

BACKGROUND OF THE INVENTION

1. Field of the Invention

The present invention relates generally to the field of storage and carrying bags and more specifically to worksite storage or carrying bag designed to hold and protect various tools and accessories and which is equipped with a flexible, expandible pocket construction.

2. Description of the Prior Art

In the past, some companies have offered either metal or hard plastic tool boxes that have a hinged top and a small removable tray that lifts out to reveal the inner confines of the box for bulk tool storage. Some have small mounted drawers either in the top or the bottom for smaller tools or loose fasteners. Since these boxes are made of metal, hard plastic or rubber, they often do not conform to unique storage situations in real life trade applications. For a tradesman, storage in a vehicle is critical and sometimes a specific space for a rectangular hard box is not available. Some pick-up trucks have storage space behind the seats that do not lend itself to a rectangular box shape. Additionally, the surface of these boxes is slick and the boxes will quickly slide around if not properly wedged or packed tightly for security.

Another more recently introduced product in the marketplace is the "soft" or synthetic fabric tool bag which is available in different sizes and configurations. It is known in the art to produce a bag of this type that is required to carry substantial loads for various situations. These bags have numerous designs for various specific functions. Some of these are very similar to a doctor's bag with a zippered opening providing access to an inside cavity where tools lay horizontally. These synthetic fabric bags offer an improvement to the metal and plastic boxes by overcoming many of the deficiencies discussed above. However, these designs fail to address many concerns for a bag in use, for example, by a plumber, carpenter or an electrician at a construction or job site.

Thus, despite the advantages offered by the soft-sided bags, there continues to exist a need for improvements in tool bags of the type used by carpenters, plumbers, electricians and similar tradesmen. For example, many prior bag designs, though good for light loads, have features which are not well suited for carrying larger loads that require a great deal of strength. The handles and sidewall construction of many of the prior art designs are not sufficiently robust or of industrial strength for use by tradesmen. Also, it would be advantageous to provide an external expandible pocket construction for soft sided tool bags of this general type in order to better accommodate the various tools and accessories used by those in the industry.

There exists a need, therefore, for an improved expandible pocket design for a soft sided tool bag of the type used by carpenters, electricians, and the like.

There also exists a need, therefore, for an improved soft-sided tool bag which has a sidewall construction and a handle arrangement which is able to accommodate heavier loads.

There exists a need for such a tool bag which provides increased load carrying ability for the bag and overall structural reinforcement, while utilizing a soft sided construction.

SUMMARY OF THE INVENTION

The present invention is a heavy-duty soft-sided tool bag which is well adapted for use, for example, at a construction work site by a plumber, carpenter or electrician. The bag has a bottom panel from which extends a plurality of sidewalls each having a bottom edge attached to the bottom panel and having an outside surface and an inside surface, the sidewalls together with the bottom panel defining a bag exterior and a bag interior. At least one carrying handle or element is provided which connects selected sidewalls of the bag. At least one expandible pocket is located on the bag exterior, the expandible pocket having an outer panel, an intermediate zippered panel and an expandible pleated panel which connects the zippered panel to the bag exterior. The pleated panel is connected to the zippered panel and to the outer panel at selected spaced locations by a length of stretch material, whereby the expandible pocket may be expanded from an initial volume to an expanded volume by stretching the pleated panel and the accompanying stretch material.

Preferably, the sidewalls of the bag are arranged as a pair of relatively narrow opposing sidewalls and a pair of relatively wider opposing sidewalls, and wherein selected ones of both the narrower and wider sidewalls are equipped with expandible pockets. The carrying element can comprise a pair of handle straps, each having a first and second planar end portions and an intermediate portion, wherein the first and second planar end portions of each handle strap are attached to selected opposing sidewalls of the bag, the intermediate portion of each strap forming a carrying handle for the bag. The carrying element can also comprise a single rigid handle element having first and second end portions and an intermediate portion, wherein the first and second end portions of the rigid handle element are attached to selected opposing sidewalls of the bag, the intermediate portion of the handle element forming a carrying handle for the bag.

In one version, the bag has a closed position and an open position in which the opposing sidewalls carrying the handles form substantially vertical parallel planes with respect to each other and a substantially perpendicular plane with respect to the bottom panel, whereby the handles present a full-width and non-obstructed opening for the bag. In another version, the relatively narrow opposing sidewalls and the pair of relatively wider opposing sidewalls are all arranged generally perpendicular to the bottom panel of the bag so that the bag always presents a full width opening, and wherein a single rigid handle element connects the relatively narrower pair of opposing sidewalls.

Additional objects, features and advantages will be apparent in the written description which follows.

DETAILED DESCRIPTION OF THE INVENTION

Figure 1:
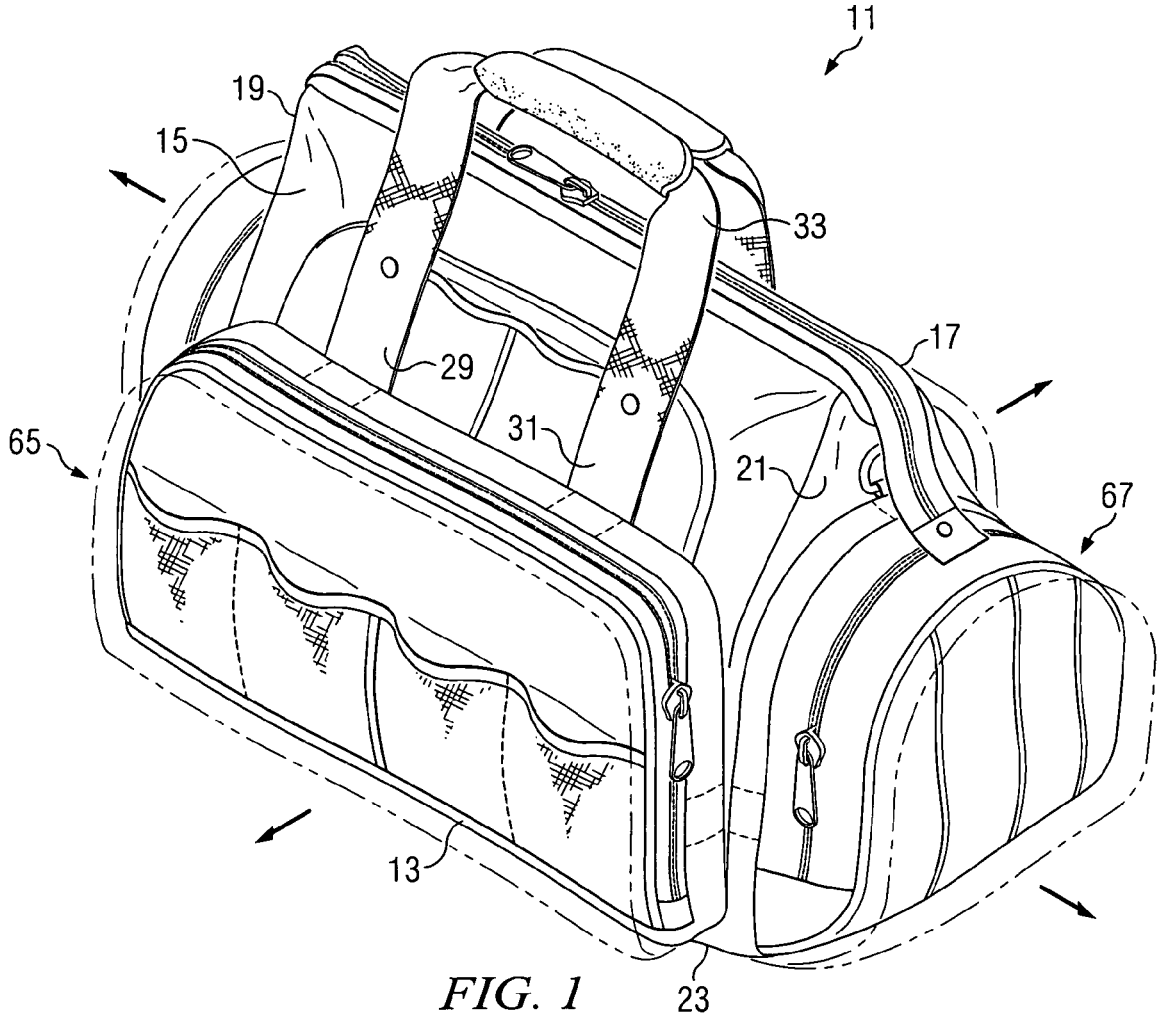
FIG. 1 is a perspective view of the tool bag according to the present invention having an A-frame construction.

Turning to FIG. 1, there is shown a soft sided tool bag 11 for carrying a workman's tools. Although the bags of the invention can be used for a variety of purposes, there are primarily directed toward the needs of a workman such as a carpenter, electrician, plumber or the like who has need for transport and easy access to tool at a work or construction site. These tools can range from fairly small items, such as a screwdriver, to fairly large, heavy and bulky items such as, for example, a five inch circular saw. One object of the present invention is to provide a soft sided tool bag which is robust enough to accommodate a variety of tools of the above type which a workman might need to transport and which also is equipped with expandible pockets for accommodating a variety of additional tools and accessories.

The bag 11 includes a bottom panel 13 and a plurality of sidewalls, such as sidewalls 15, 17, 19, 21. Each sidewall has a bottom edge, such as edge 23 in FIG. 1, attached to the bottom panel 13. In the case of the bag 11, shown in FIG. 1, the opposing sidewalls 15, 17 comprise an A-frame for the bag when in the closed position illustrated. Each of the opposing sidewalls 15, 17 also has attached thereto a carrying element such as the flexible carrying straps 25, 27. Each of the carrying straps has first and second planar end portions 29, 31 and an intermediate portion 33. The intermediate portion 33 forms a carrying handle for the bag. The bag sidewalls are formed of a soft but durable fabric material, such as ballistic nylon.

Figure 2:
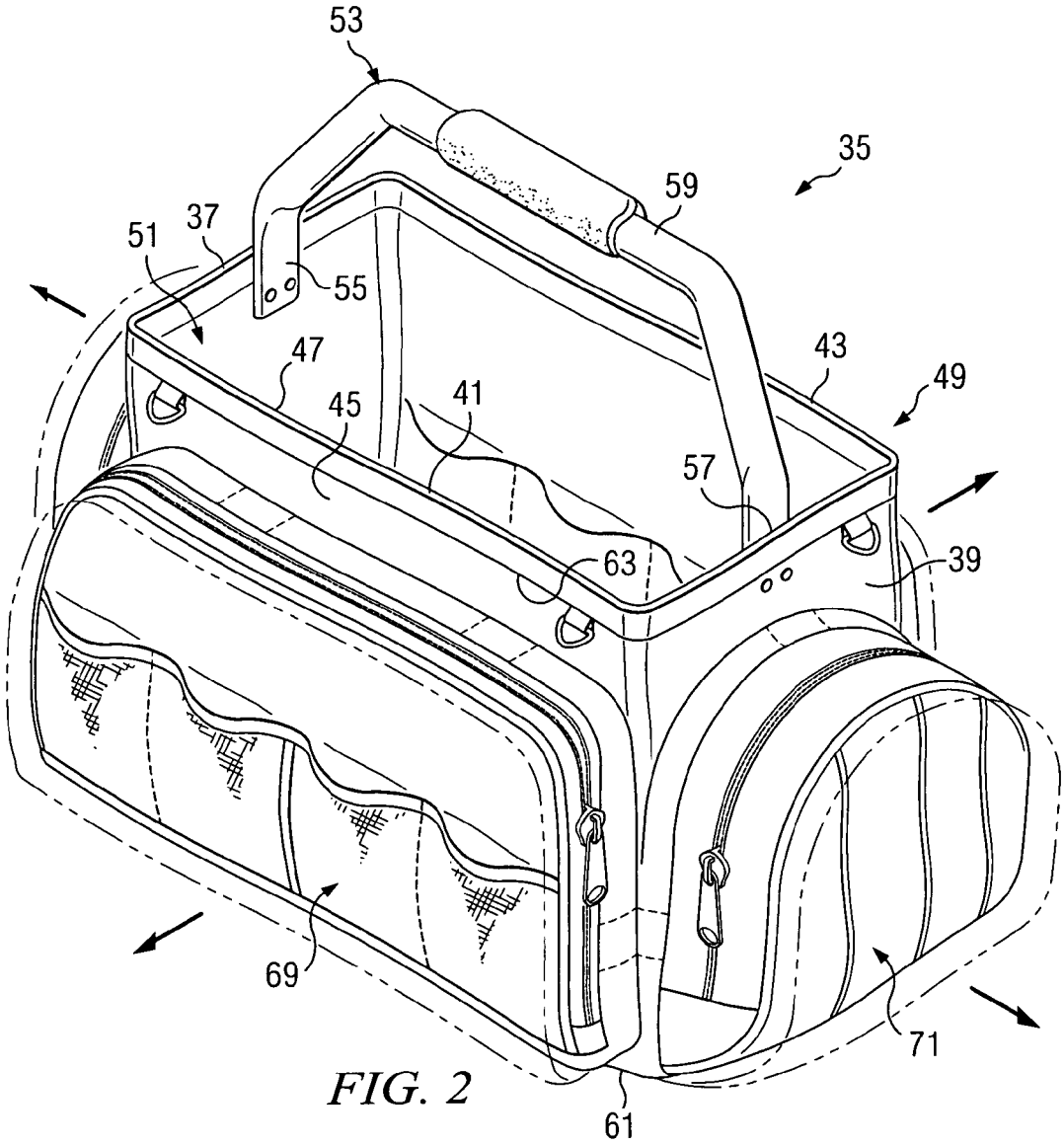
FIG. 2 is a perspective view of another bag of the invention, the bag having a fixed, rectangular opening.

With reference to FIG. 2, another version of the soft-sided tool bag 35 is illustrated. In this version of the bag, the sidewalls are arranged as a pair of relatively narrow opposing sidewalls 37, 39 and a pair of relatively wider opposing sidewalls 41, 43. As in the case of the first bag, the sidewalls have an outside surface 45, an inside surface 47, the sidewalls together with the bottom panel defining a bag exterior 49 and a bag interior 51. In the case of the bag 35 illustrated in FIG. 2, a single rigid handle element 53 has a first and second end portions 55, 57 and an intermediate portion 59. The first and second end portions 55, 57 of the rigid handle element are attached to selected opposing sidewalls 37, 39 of the bag. The intermediate portion 59 of the handle element forms a carrying handle for the bag. The handle element 53 can be formed of any rigid, lightweight material, such as aluminum with the intermediate portion 59 being wrapped with a fabric material to facilitate gripping and carrying.

With reference to FIG. 2, it can be seen that the relatively narrow opposing sidewalls 37, 39 and the pair of relatively wider opposing sidewalls 43, 45 are arranged generally perpendicular to the bottom panel 61 of the bag so that the bag always presents a full width mouth opening with the single handle element 53 connecting the relatively narrower pair of opposing sidewalls 37, 39. The circumferential mouth region 63 is reinforced with longitudinal stiffening elements so that the mouth opening remains permanently in the open position illustrated in FIG. 2.

Figure 3:
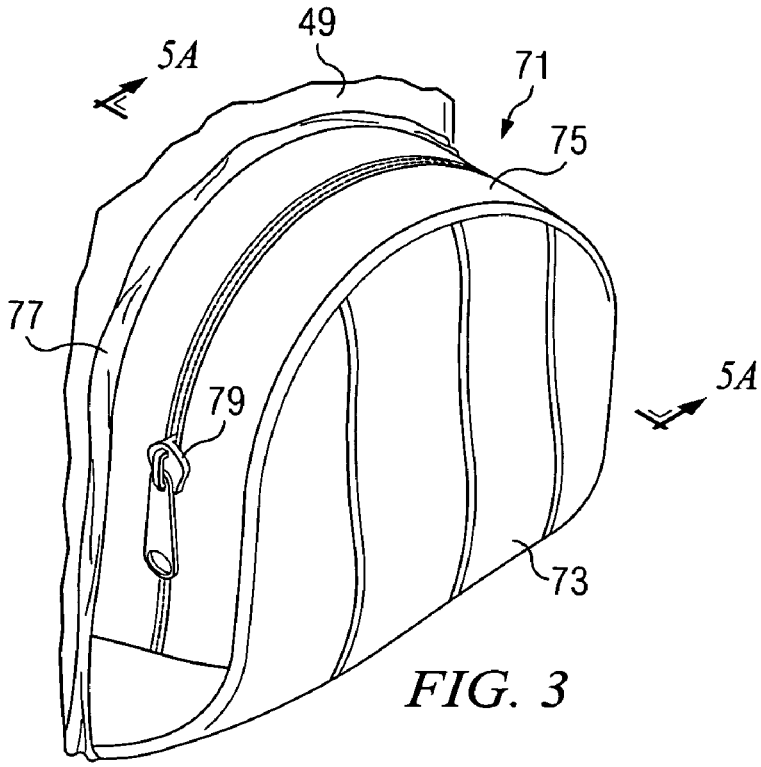
FIG. 3 is an isolated view of one of the expandible pockets of the bag of the invention, showing the pocket in the relaxed position.

With reference to both FIGS. 1 and 2, each of the bags 11, 35 has at least one and preferably a plurality of expandible pockets, such as pockets 65, 67 and 69, 71 which are located on the bag exteriors. As shown in FIGS. 3-5B, the expandible pockets, such as pocket 71 shown in FIG. 3 is comprised of an outer fabric panel 73, and intermediate zippered panel 75 and an expandible pleated panel 77 which connects the zippered panel to the bag exterior 49. The pleated panel 77 might be sewn directly to the bag exterior 49 or might be sewn to an inner panel which overlays the bag exterior 49 upon assembly. The intermediate panel 75 is generally arcuate in configuration and contains a standard zipper element 79.

Figure 4:
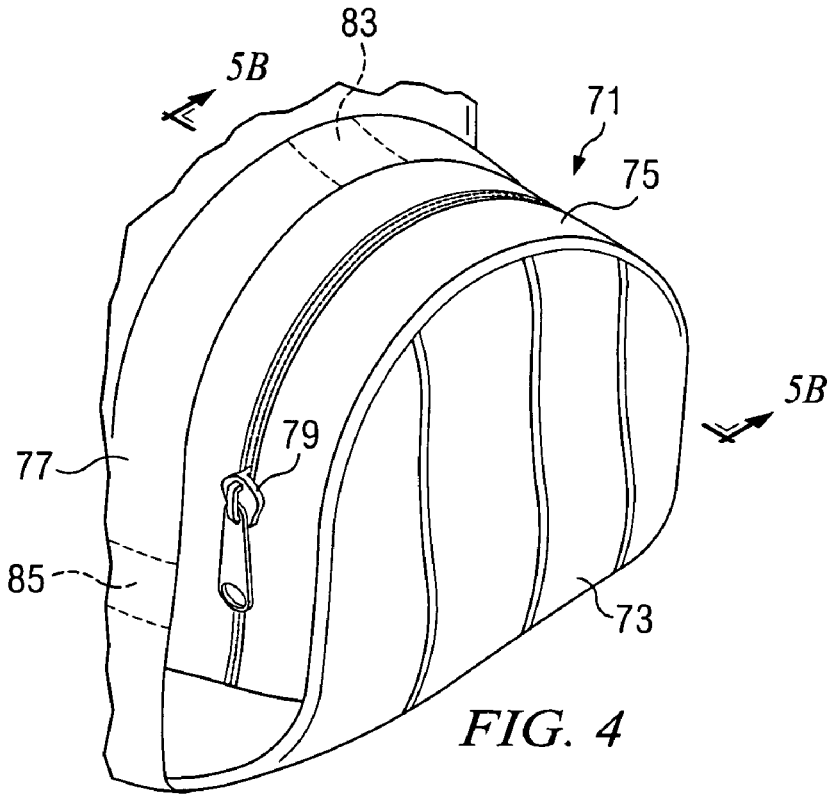
FIG. 4 is a view similar to FIG. 3, but showing the pocket in the expanded position.
Figure 5A:
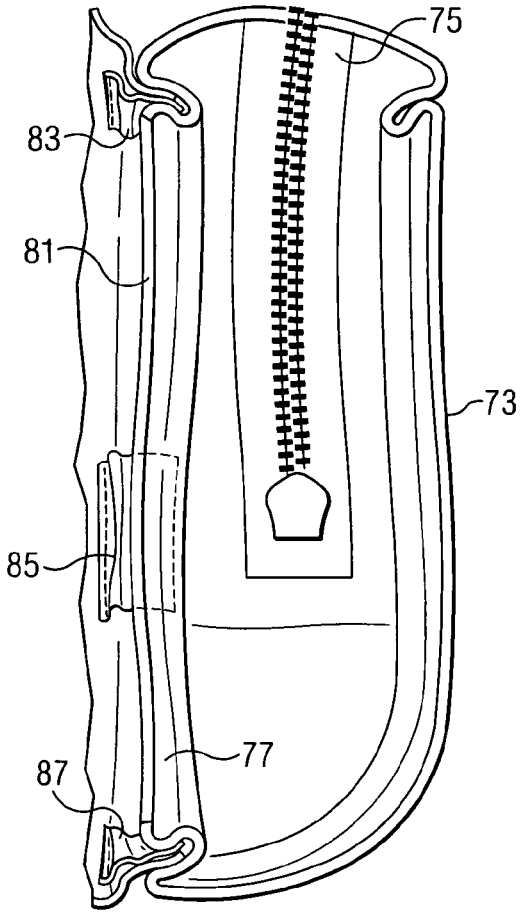
FIG. 5A is a side view of one of the expandible pockets of the invention with portions broken away in order to better illustrate the pleated panel and associated stretch elements thereof, the pocket being shown in the relaxed position.
Figure 5B:
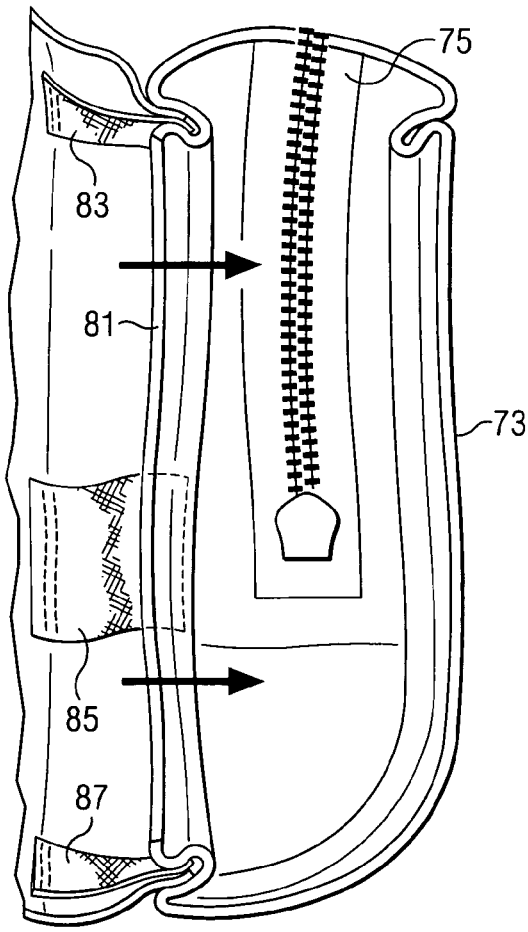
FIG. 5B is a view similar to FIG. 5A, but showing the pleated panel in the expanded position.

With reference to the broken away side view of FIGS. 5A and 5B, it can be seen that the pleated panel 77 is connected to the zippered panel 75 along a seam line 81. The pleated panel 77 is also attached to the zippered panel 75 at selected spaced locations by lengths of stretch material, such as longitudinal strips 83, 85, 87 illustrated in FIG. 5A. As can be seen in FIG. 5B, the lengths of stretch material 83, 85, 87 are arranged longitudinally with respect to the plane of the outer panel 73. As can best be appreciated from FIGS. 3 and 4, the use of spaced lengths of stretch material allows the pleated panel portion of the pocket to assume a relaxed and collapsed state as shown in FIG. 3 but allows the pocket to be expanded elastically to the extended position shown in FIG. 4 to accommodate larger tools or accessory items. The view of FIG. 4 shows the expandible pleated panel 77 in the expanded state and illustrates the lengths of stretch material 83 and 85 in dotted lines since the stretch material is normally hidden from view within the interior of the pocket.

The particular construction shown allows the expandible pocket 71 to be expanded from an initial volume to an expanded volume by stretching the pleated panel and accompanying stretch material. This allows the pocket to assume a greater volume without the necessity of providing, for example, an additional zippered closure which could be unzipped to reveal an expandible pleat. The use of the lengths of stretch material which are concealed within the pocket interior in normal use also eliminates the need for forming the pleated panel 77 entirely of stretch or mesh material which would add to the cost of the bag manufacture.

As shown in the drawings, the bag sidewalls and pockets, including the pleated panels, can be formed of the same material, for example, from ballistic nylon shell material, or any other convenient durable material. The sidewalls of the bag may be reinforced in some circumstances. For example, a bag might be formed having inner and outer ballistic nylon shell panels with an open cell polyurethane liner disposed there between. The tools bags of the invention typically present a relatively large footprint. This large footprint allows for the storage of numerous tools of various sizes not currently accommodated by many of the other currently available tool bags. For example, the exemplary "giant tool bag" shown in FIG. 2 may have a footprint on the order of 21 inches in width by 47 inches in length. Furthermore, the exterior pockets allow for the additional storage of tools and other attendant accessories.

An invention has been provided with several advantages. The collapsible soft-sided tool bags of the invention are sturdy enough to accommodate even relatively heavy and bulky tools and accessory items. The bag can be provided in either an A-frame style with a full opening mouth and flexible handles or in a fixed mouth opening configuration with a relatively rigid carrying handle. The rigid handle element which spans two opposing sidewalls of the fixed mouth opening bag facilitates transport of heavier, bulky items. The bags of the invention also feature a plurality of exterior pockets with expandible pleated panels which allow the pockets to be expanded between collapsed and extended positions to accommodate various types of tools, items and accessories. The unique stretch material construction presents a neat external appearance and yet provides the flexibility of a expandible pocket construction without the attendant expense of the use of special fabric materials for the pleated panel portion of the pocket.

While the invention has been shown in only two of its forms, it is not thus limited but is susceptible to various changes and modifications without departing from the spirit thereof.

What is claimed is:

1. A soft-sided tool bag for carrying a workman's tools, comprising:

a bottom panel;

a plurality of sidewalls each having a bottom edge attached to the bottom panel and having an outside surface, an inside surface, the sidewalls together with the bottom panel defining a bag exterior and a bag interior;

at least one carrying element connecting selected sidewalls of the bag;

at least one expandible pocket located on the bag exterior, the expandible pocket having an outer panel, an intermediate zippered panel carrying a zipper and an expandible pleated panel which connects the zippered panel to the bag exterior;

wherein the pleated panel is connected to the zippered panel and to the outer panel at selected spaced locations within an interior of the expandible pocket by a plurality of lengths of stretch material, whereby the expandible pocket may be expanded from an initial volume to an expanded volume by expanding the pleated panel and stretching the accompanying stretch material, whereby the pocket is expanded elastically between a relaxed and collapsed state and an extended position;

wherein at least three lengths of stretch material connect the zippered panel to the pleated panel, the three lengths being arranged to run from the pleated panel to a top central region of the zippered panel and on either of opposite downwardly extending side regions of the zippered panel;

wherein the sidewalls of the bag are arranged as a pair of relatively narrow opposing sidewall and a pair of relatively wider opposing sidewalls, and wherein selected ones of both the narrower and wider sidewalls are equipped with expandible pockets; and wherein the bag has a closed position and an open position, and wherein the opposing relatively wider sidewalls form substantially vertical parallel planes with respect to each other and a substantially perpendicular plane with respect to the bottom panel in the open position, whereby there is presented a full width and non-obstructed opening for the bag.

2. The soft-sided tool bag of claim 1, wherein the at least one carrying element of the bag comprises a pair of handle straps, each having a first and second planar end portions and an intermediate portion, wherein the first and second planar end portions of each handle strap are attached to selected opposing sidewalls of the bag, the intermediate portion of each strap forming a carrying handle for the bag.

3. The soft-sided tool bag of claim 1, wherein the bag sidewalls, the outer panel, the intermediate zippered panel and the pleated panel are all formed of the same fabric material.

4. The soft-sided tool bag of claim 3, wherein the fabric material is ballistic nylon.

5. The soft-sided tool bag of claim 1, wherein the lengths of stretch material are arranged in longitudinal planes generally perpendicular to a plane of the outer panel.

* * * * *